United States Patent [19]

Engel et al.

[11] Patent Number: 4,798,916

[45] Date of Patent: Jan. 17, 1989

[54] SAFETY PLATE FOR ELECTRICAL OUTLET

[76] Inventors: Stephen M. Engel, 512 N. Highland; Wallace W. Weiger, 1005 W. 2nd, both of Pierre, S. Dak. 57501

[21] Appl. No.: 109,758

[22] Filed: Oct. 19, 1987

Related U.S. Application Data

[63] Continuation-in-part of Ser. No. 91,722, Aug. 28, 1987, abandoned.

[51] Int. Cl.[4] ..... H01R 13/453

[52] U.S. Cl. ..... 174/67; 439/137

[58] Field of Search ..... 174/67; 220/242; 439/137, 140, 145

[56] References Cited

U.S. PATENT DOCUMENTS

| | | | |
|---|---|---|---|
| 2,477,803 | 8/1949 | Huber | 439/137 |
| 2,710,382 | 6/1955 | Fitzpatrick et al. | 439/137 |
| 2,820,842 | 1/1958 | Meistrell | 174/67 |
| 3,068,442 | 12/1962 | Kubik et al. | 439/136 |
| 3,222,631 | 12/1965 | Cohen | 439/137 |
| 3,865,456 | 2/1975 | Dola | 439/137 |
| 4,094,569 | 6/1978 | Dietz | 439/137 |
| 4,293,173 | 10/1981 | Tricca | 174/67 X |
| 4,600,258 | 7/1986 | Hu | 439/140 |
| 4,640,564 | 2/1987 | Hill | 439/137 |

FOREIGN PATENT DOCUMENTS 2256558 7/1975 France .

*Primary Examiner*—Arthur T. Grimley
*Assistant Examiner*—D. A. Tone
*Attorney, Agent, or Firm*—Zarley, McKee, Thomte, Voorhees & Sease

[57] ABSTRACT

A safety plate for electrical outlets is disclosed which includes a cover plate having a pair of openings for access to the receptacles of an outlet. A pair of slidable panels with apertures for the prongs of a plug, and are mounted to the back of the cover plate and held in place by a back plate with corresponding apertures. A spring biases the panels to misalign the panel apertures from the back plate apertures, such that there is no direct opening to the electrical contacts in the receptacles. The prongs of a plug may be used to slide a panel to align the apertures to access an outlet. A raised portion on each panel fits slidably within the cover plate opening and is flush with the prong surface, so that oversize plugs may be used with the safety plate. A gasket along the back perimeter of the cover plate seals any air leaks.

8 Claims, 2 Drawing Sheets

SAFETY PLATE FOR ELECTRICAL OUTLET

CROSS REFERENCE TO RELATED APPLICATION

This is a continuation-in-part patent application of Ser. No. 91,722, filed Aug. 28, 1987, now abandoned.

TECHNICAL FIELD

This invention relates generally to a safety cover for an electrical outlet and more particularly to an outlet cover which is energy efficient.

BACKGROUND OF THE INVENTION

Since the introduction of use of electrical power in the home, there has always been a problem of safety—especially where children are present. The earliest outlets for power were simply open sockets into which an appropriate device could be screwed to accept the contact prongs of the plug attached to an appliance. This arrangement was used because there was, at that time, direct current systems—requiring appropriate polarity.

Later, when alternating current became the overwhelming choice—because of advantages in transmitting and distributing such energy—the electrical outlets were designed having receptacles into which the two prongs of an appliance could be put. Safety was considerably enhanced by such a device. No longer could a child insert a finger into the receptacle to make contact with the power source.

More recently, outlets for receiving three-prong plugs have been used. The third aperture is simply a "ground" connection so that while safety is enhanced so far as the general user is concerned, there is no imporovement in blocking direct contact with the power source.

The principal problems with both the two- and three-prong outlet is that children frequently are explorers. They are apt to take a bit of metal such as a safety pin, a hair pin, a bit of wire, or a paper clip and poke it into those curious little holes in the electrical outlet. This sort of exploration can have disastrous results to the person holding the wire.

To avoid this kind of activity, the common solution is a plastic dummy plug. Such a plug is formed to be inserted into the outlet in a similar manner to the appliance plug. However, because the dummy is made up of an insulating plastic, the prongs simply fill the two apertures and cover the rest of the outlet so that pins or wires cannot be inserted to engage the contacts.

Such devices work reasonably well until one or more of the dummy plugs is misplaced or broken. Then the problem is which of the various outlets to leave uncovered until one remembers to purchase replacements.

A further problem with present outlets, is in the fact that heat loss occurs through the apertures and around the perimeter of the outlet cover on both exterior and interior walls. These small drafts can have a considerable effect on the cost of heating the home.

It is also a problem with prior art cover plates to change or match the color of the existing receptacle. If the outlet is old, the color of the dummy plug may not precisely match, or even be available. In those safety outlets which have a panel that slides over the receptacle apertures, it is still possible to see the receptacle through the apertures of the cover plate. Thus, a homeowner desiring a change in the color of the cover plate would be forced to completely replace the receptacle, even if the prior art cover plates were used. Furthermore, the choice of receptacle colors is currently quite limited, and would thereby limit the choice of cover plate colors as well.

It is therefore a general object of the present invention to provide an improved safety plate for an electrical outlet.

Another object is to provide a safety plate which allows the use of oversize plugs.

Yet another object of the present invention is to provide a safety plate with panels which cover the outlet apertures, the panels being slidable but not removable from the safety plate.

Still another object is to provide a safety plate which completely seals the outlet in the wall for energy efficiency.

Yet a further object of the present invention is to provide a safety plate which completely covers the existing receptacle, so that it cannot be seen when in use or non-use.

These and other objects will be apparent to those skilled in the art.

SUMMARY OF THE INVENTION

A safety plate for electrical outlets is disclosed which includes a cover plate having a pair of openings for access to the receptacles of an outlet. A pair of slidable panels with apertures for the prongs of a plug, are mounted to the back of the cover plate and held in place by a back plate with similar apertures. A spring biases the panels out of alignment with the back plate apertures, such that there is no direct opening to the electrical contacts on the receptacles. The prongs of a plug may be used to slide a panel to align the apertures to access an outlet. A raised portion on each panel fits slidably within the cover plate opening and is flush with the front surface, so that oversize plugs may be used with the safety plate. A gasket along the back perimeter of the cover plate seals any air leaks. Because a back plate seals the panel apertures when not in use, heat loss through the panel apertures is virtually eliminated, and the receptacle is also completely hidden from view.

DESCRIPTION OF THE PREFERRED EMBODIMENT

Figure 1:
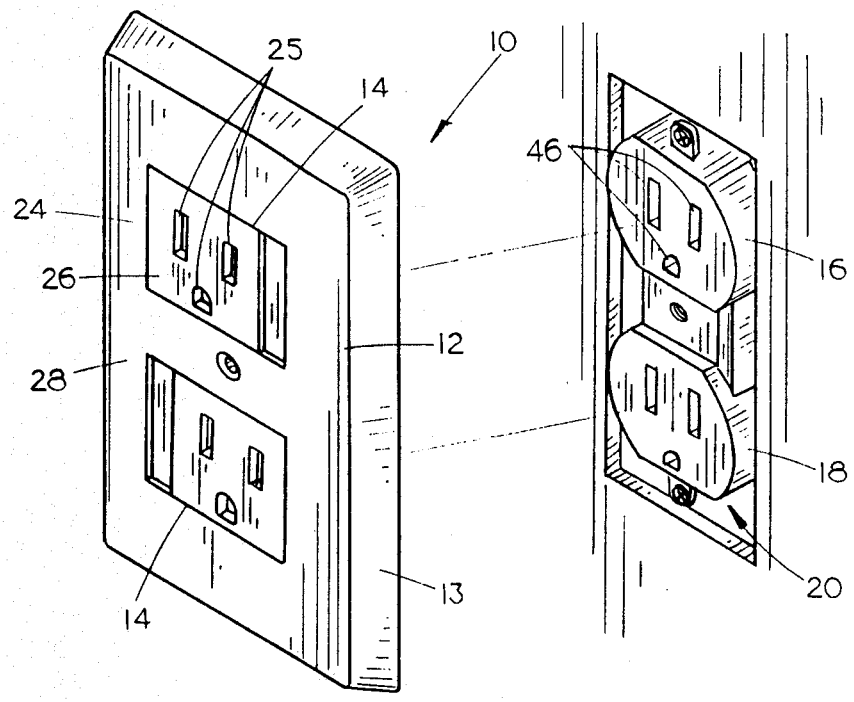
FIG. 1 is a perspective view of the invention.

Referring now to the drawings, in which similar or corresponding parts are identified by the same reference numeral, the safety plate of this invention is referred to generally at 10 and includes a front cover plate 12 having a rearwardly projecting lip 13 around its perimeter, and a pair of rectangular openings 14 which allow access to an upper and lower receptacle 16 and 18 in a conventional outlet 20. Cover plate 12 has the same dimensions as a conventional outlet cover, making replacement simple and convenient.

Figure 2:
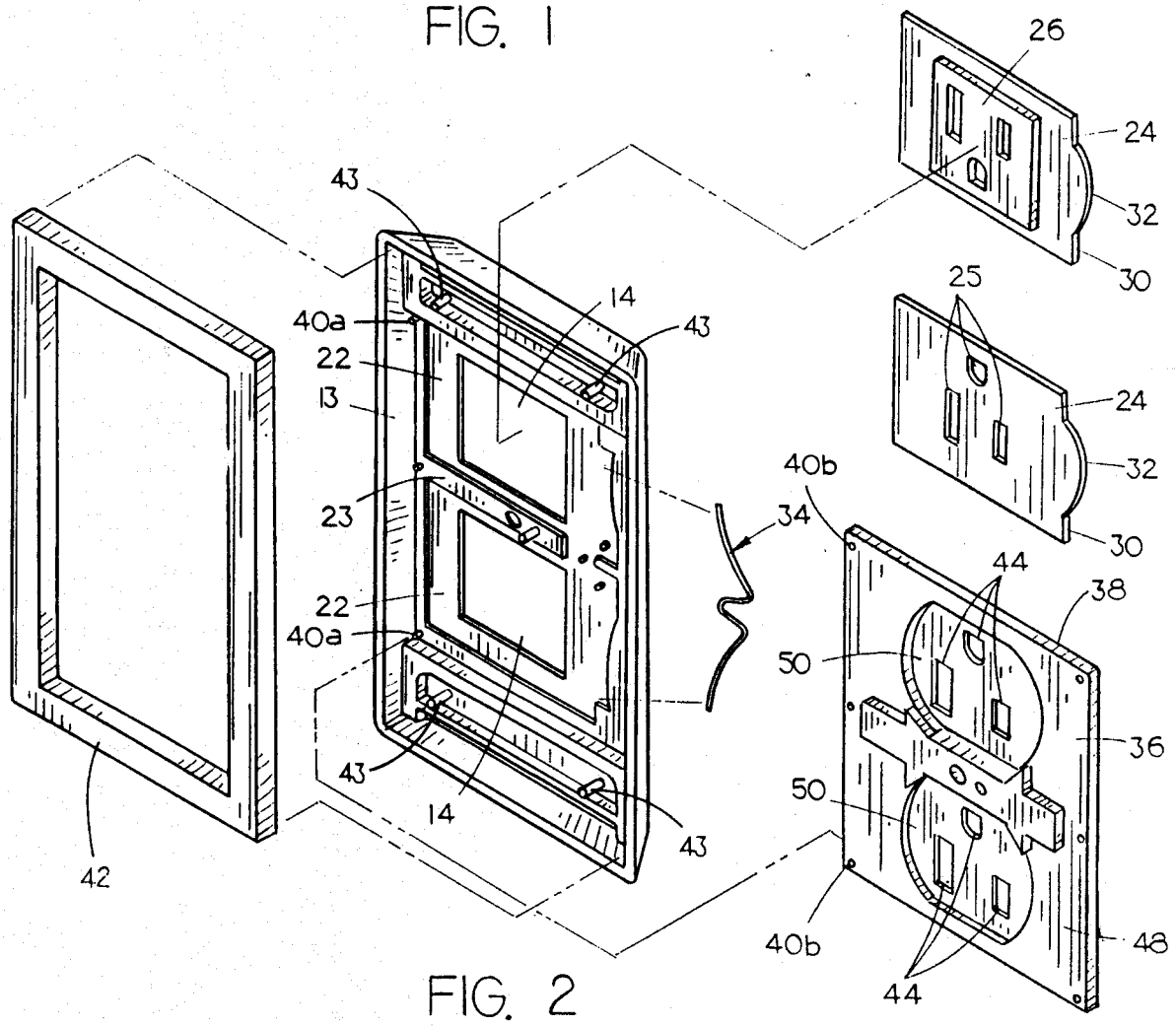
FIG. 2 is an exploded rearward perspective view of the invention.

Referring now to FIG. 2 the back of cover plate 12 has a pair of rectangular depressions 22 therein which surround openings 14. Depressions 22 are partially separated by a narrow strip 23. A pair of panels 24 slide horizontally within depressions 22, as seen in the figures. Each panel 24 has a raised portion 26 which is flush with the front surface 28 of cover plate 12 (see FIG. 1). The width of raised portions 26 is less than the width of openings 14, such that panels 24 will slide horizontally therein. Panels 24 have apertures 25 therein, which correspond with the prongs of a three-prong plug. The use of a flush surface between the raised portion of the slidable panels 24 and the front surface 28 of the cover plate 12 allows the user to utilize an oversize plug in outlet 20. Without this flush surface, an oversize plug could not be properly seated in panels 24 to provide a safe connection to the power source. The flush surface also reduces the visible differences between the inventor's safety plate and a conventional cover plate. The use of a dramatically different looking cover plate on an outlet not only is aesthetically unappealing, but could actually attract a child's attention to the outlet.

One side edge 30 of each panel 24 has an arcuate portion 32 projecting therefrom which will abut a spring 34, thereby biasing panels 24 to slide in one direction within depression 22.

A back plate 36 has a flat forward facing surface 38 which covers depressions 22 so as to slidably hold panels 24 within depressions 22. Back plate 36 is snapped in place using peg and aperture combinations **40*a* and 40*b*, known in the art. Back plate 36 has a length and width less than that of cover plate 12, and a thickness less than the depth of cover plate lip 13, such that it will fit within the back of cover plate 12**.

Figure 4:
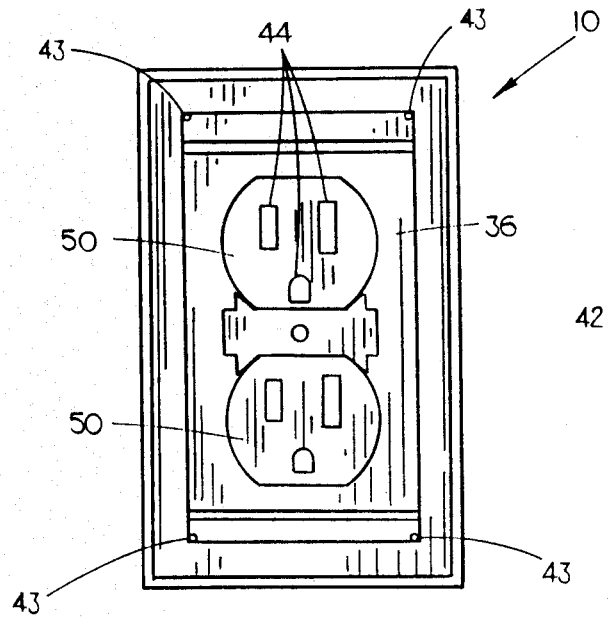
FIG. 4 is a rear elevational view.

A gasket 42 of thermal insulating material is affixed within the perimeter of lip 13, and has a thickness great enough to project out the back of cover plate 12, beyond lip 13. Gasket 42 is held in position by four pegs 43 spaced from lip 13, gasket 42 being journaled between pegs 43 and lip 13 as shown in FIG. 4. Gasket 42 is a resilient material, such that upon fastening plate 12 over an outlet 20, gasket 42 will be sealably compressed against the wall. In this way, cold air within the wall cannot escape around the perimeter of cover plate 12.

Back plate 36 also has apertures 44 therein which are aligned with the apertures 46 in receptacles 16 and 18 of outlet 20. When panels 24 are biased to one side by spring 34, the panel apertures 25 are out of alignment with receptacle apertures 46, and back plate 36 thereby serves to seal the panel apertures 25 from allowing cold air to escape therethrough. Outlet 20 is still accessible for use by aligning panel apertures 25 with back plate apertures 44, and thereby receptacle apertures 46.

Back plate 36 also serves to completely hide the receptacles 16 and 18 from being seen through the apertures 25 and panels 24. This eliminates the need for the consumer to remove and change the existing receptacles 16 and 18 if the color cannot be matched with the cover plate or if it is desired to change the color of the outlet.

As seen in FIG. 2, the back surface 48 of back plate 36 has a pair of depressions 50 which correspond with receptacles 16 and 18. This allows a closer fit of cover plate 12 to receptacles 16 and 18 thereby increasing the energy efficiency of the cover 10 and allowing a lower profile of the cover plate 12.

Figure 3:
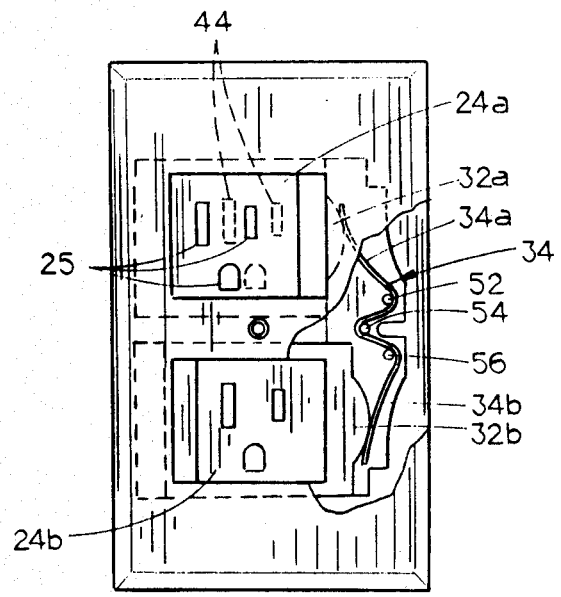
FIG. 3 is a front elevational view with a portion broken away to expose inner details.

Referring now to FIG. 3, it can be seen that spring 34 serves to bias both panels 24 horizontally so as to misalign the panel apertures 25 from the back plate apertures 44. A set of three pegs 52, 54 and 56 are used to hold spring 34 in position, and to relieve the biasing strain from each half **34*a* or 34*b* of spring 34 from affecting the biasing of the other half of the spring. It can therefore be seen that sliding lower panel 24*b* against spring half 34*b* will cause spring 34*b* to first pivot about peg 56 and then about peg 54. This biasing action is thus kept from transmitting to spring half 34*a* by the bend around peg 54. Likewise, spring half 34*a* pivots about peg 52 and then peg 54** in a similar manner and with similar results.

Each spring half **34*a* and 34*b* is bent arcuate in a direction opposite to the arcuate portions 32 of panels 24**. These abutting arcuate surfaces assist in eliminating the possibility of the panel catching during sliding. A smooth and more reliable biasing and sliding action thereby occurs.

To use the safety plate 10, cover plate 12 is fastened in the usual manner to a conventional outlet 20. The normal position of panels 24 is shown at the top portion of FIG. 3. In this normal position, panels 24 are pushed by spring 34 to the location in which panel apertures 25 do not register with back plate apertures 44. Thus, it would be impossible for anything such as a wire, safety pin, or the like to be inserted into the apertures in the receptacle to make electrical contact with the power source.

When the normal use of power through the outlet 20 is desired, the prongs of a plug may be inserted into panel apertures 25, then moved slightly to the right (as seen in the figures) pushing panel 24 against the biasing action of spring 34 until panel apertures 25 are registered with the underlying apertures in the back plate and receptacles. The prongs of the plug may then be inserted into the receptacle. Upon removal of the plug from the receptacle, panel 24 will spring back to its normal position under the bias of spring 34, and receptacles 16 and 18 will again be covered to prevent insertion of material by children.

It can therefore be seen that at least all of the above stated objectives are fulfilled by the present invention.

We claim:

1. A safety plate for a conventional electrical outlet of the type having a pair of receptacles, each receptacle having apertures therein for receiving the prongs of an electrical plug, comprising:

a cover plate having a pair of vertically aligned openings therethrough, the openings located so as to be centered over the receptacles of an outlet when the cover plate is fastened thereto;

said cover plate having a front surface, rearward surface, and a rearwardly projecting lip extending around the perimeter thereof;

the rearward surface of said cover plate having a pair of depressions therein for receiving slidable panels and a biasing means, the depressions surrounding the openings in said cover plate;

a pair of panels slidably mounted in the depressions in said cover plate;

said panels having a raised portion projecting forwardly through said cover plate openings so as to be flush with the front surface of said cover plate, said raised portion having dimensions to allow only horizontal slidable movement of the panel in said cover plate;

said panels further having apertures therein corresponding to the apertures in said receptacles, and in alignment therewith when said panels are in a use position;

biasing means connected to the rearward side of said cover plate adapted to bias said panels from their use position where the panel apertures are aligned with the receptacle apertures, to a non-use position where the panel apertures are misaligned from the receptacle apertures;

a back plate having apertures therethrough corresponding with said receptacle apertures and in alignment therewith when the cover plate is attached to the outlet, said back plate fastened to the rearward surface of said cover plate, and enclosing said slidable panels and biasing means within said depressions in the cover plate; and means for removably attaching said cover plate to a conventional outlet.

2. The safety plate of claim 1, wherein said cover plate has openings further characterized as being rectangular in shape and wherein the raised portions of said slidable panels are rectangular in shape and journaled for horizontal slidable movement within said openings.

3. The safety plate of claim 1, wherein said biasing means is a spring means having upper and lower ends, the upper end being positioned to bias against one side edge of the upper slidable panel, and said spring means lower end being positioned to bias against one side edge of the lower slidable panel.

4. The safety plate of claim 3, wherein said biased side edge of said panels has an arcuate portion projecting against said spring means, and wherein the upper and lower ends of said spring means are bent arcuate in the opposite direction of said panel arcuate portions, such that an arcuate portion of the spring ends abuts the arcuate portion of the panels throughout the slidable extent of said panels.

5. The safety panel of claim 3, wherein said spring means includes an upper half and lower half, said spring means being mounted for independent biasing of said upper and lower spring halves.

6. The safety plate of claim 5, wherein said spring means is generally M-shaped, and includes a pair of outer legs and a pair of inner legs, one outer leg and adjoining inner leg forming said spring upper half, and the other outer leg and adjoining leg forming said spring lower half, each outer leg of said spring means being pivotable around a point on said cover plate between the outer leg and adjoining inner leg and adjacent the connection of each outer and inner leg, each outer leg pivoting thereabout from a position where the panel is fully biased to one side and an intermediate position, and each said upper and lower spring half being independently pivotal about a fixed point between said inner legs adjacent the connection of said inner legs, each said upper and lower half pivoting therearound from said intermediate position to a position where said panels are fully unbiased.

7. The safety plate of claim 1, wherein said cover plate further includes a gasket of thermal insulating material extending continuously around the perimeter of said cover plate interiorly of said lip, said gasket having a thickness greater than the depth of said lip to form a compressive seal against the wall when said cover plate is mounted to a wall outlet.

8. The safety plate of claim 7, further comprises means for holding said gasket in position around the perimeter of said cover plate.

* * * * *